United States Patent [19]

Beisiegel et al.

[11] Patent Number: 4,820,947

[45] Date of Patent: Apr. 11, 1989

[54] BEARING AND RING-SHAPED DRIVE MOTOR ENCLOSED IN COMMON HOUSING

[75] Inventors: Diethelm Beisiegel, Gerstetten; Erwin Binder, Heidenheim, both of Fed. Rep. of Germany

[73] Assignee: J. M. Voith GmbH, Fed. Rep. of Germany

[21] Appl. No.: 103,501

[22] Filed: Oct. 1, 1987

[30] Foreign Application Priority Data

Mar. 6, 1987 [DE] Fed. Rep. of Germany ..... 8703410

[51] Int. Cl.[4] ..... H02K 5/00; H02K 9/00; B23B 19/02

[52] U.S. Cl. ..... 310/89; 310/90

[58] Field of Search ..... 34/52, 121, 128; 310/75 R, 89, 40 MM, 90, 156, 68 D, 52

[56] References Cited

U.S. PATENT DOCUMENTS

| | | | |
|---|---|---|---|
| 3,476,960 | 11/1969 | Rees | 310/89 |
| 3,704,921 | 12/1972 | Skytta | 34/121 |
| 4,100,440 | 7/1978 | Binder et al. | 310/68 D |
| 4,340,830 | 7/1982 | Hoyer-Ellefsen | 310/89 |
| 4,495,712 | 1/1985 | Justus | 34/52 |
| 4,580,471 | 4/1986 | Oyama et al. | 310/90 |

*Primary Examiner*—Patrick R. Salce
*Assistant Examiner*—D. L. Rebsch
*Attorney, Agent, or Firm*—Ostrolenk, Faber, Gerb & Soffen

[57] ABSTRACT

A journal of a drying cylinder or the like, in a paper, cardboard or coating machine, is mounted in a bearing housing which is supported in fixed position on a frame. A hollow, cylindrically widened housing for an electric drive motor is formed as an extension of the bearing housing toward the drying cylinder. This motor housing, together with the bearing housing, forms a continuous outer surface for the drive system. The motor is a permanent-magnet motor whose stator has electromagnet poles which are arranged in the hollow cylindrical housing. Its rotor has permanent-magnet poles, which form a hollow cylindrical ring mounted on the circumference of the journal. The drive system consists of only a few parts, requires only a small amount of space for installation, and is easily and inexpensively serviceable.

17 Claims, 1 Drawing Sheet

10
11
12
13
14
15
16
17
18
19
20
21
22
23
24
25
26
27
28
29
30
31
32
33
34
35
36

20'
18'
15'
38'
40'
37'
III
41'
39'

II
40'
15'
42'
41'
20'
II

BEARING AND RING-SHAPED DRIVE MOTOR ENCLOSED IN COMMON HOUSING

BACKGROUND OF THE INVENTION

This invention relates to a drive system for a drying cylinder or the like in a paper, cardboard or coating machine. More particularly, the invention relates to a drive system having a simplified structure and a substantially continuous outer wall surface surrounding a ring-shaped permanent-magnet motor mounted around the journal of the drying cylinder.

DESCRIPTION OF RELATED ART

A drive system of interest is disclosed in U.S. Pat. No. 4,495,712 (FIGS. 1–3). In that system, a spur gear is connected to the journal of the drying cylinder between the end wall thereof and the bearing housing. The gear, which is of relatively large diameter, meshes with a pinion which is mounted on a shaft and coupled to an electric drive motor. The motor, and the bearing housing of the journal, are both connected to a frame structure which receives the gearing and supports the drying cylinder. This known drive system is very expensive to manufacture and also requires expensive maintenance and stocking of spare parts. This is because of the high-speed drive motor, and the gearing with coupling and housing which is necessary in order to reduce the speed of rotation. Also, this system requires a certain amount of space for installation, which makes accessibility to the drying cylinder difficult.

SUMMARY OF THE INVENTION

The principal object of the present invention is to create a drive system of the aforementioned type which includes only a few parts and takes up only a small amount of space for installation.

A further object is to provide a drive system that is easier and less expensive to maintain than prior types of systems.

These and other objects are attained by a drive system for rotating a workpiece such as a drying cylinder or the like, comprising a frame; a bearing housing supported on the frame; a bearing in the bearing housing; a journal having a longitudinal axis, the journal having a first portion which is drivingly secured to the workpiece to be rotated, and a second portion remote from the workpiece which is supported in the bearing, and the bearing housing having an outer wall surrounding the bearing and the second portion of the journal; a drive motor adjacent the journal and drivingly connected to the journal; and a motor housing surrounding the drive motor, having an outer wall which is joined to the outer wall of the bearing housing, to form a substantially continuous outer surface for the drive system. Preferably, the outer walls of the motor housing and bearing housing are cylindrical, are concentric with the journal, and are joined by a generally radial portion. The drive motor preferably is a permanent-magnet motor surrounding the journal at a location intermediate the first and second portions of the journal.

This solution is advantageous since, with the elimination of a transmission, the drive power of the motor is transmitted directly to the drying cylinder, and the fixed bearing housing serves as both a motor support and a torque support. In the invention, the entire drive system occupies the space which is required by just the gearing in prior known devices. The permanent-magnet motor (known, for instance, from European Patent Application No. 0 052 343) which is employed herein as a drive motor for the drying cylinder, is particularly suitable for this use because of its good adjustability and because its rotor, which is subjected to heat from the journal, has no windings. The high thermal capacity of the magnet materials of the rotor magnet poles, as compared with the lacquer insulation of the winding of traditional electric motors, is very advantageous.

According to a further advantageous aspect of the invention, the drive system has a heat-insulating layer located between the journal and the rotor ring. This measure serves to reduce the heat transfer from the hot journal to the rotor.

In another development, the motor housing is closed by a cover secured to the outer walls of the motor housing at an end thereof toward the first end of the journal, and a seal is provided between the cover and the journal for sealing the motor housing. This measure protects against contact and the penetration of foreign bodies and liquids into the inside of the motor.

Respective axially-directed shoulders may be formed on either the cover or the outer wall of the motor housing, or both, for holding the stator yoke therebetween. By this feature, a form-locked and force-locked connection of the motor stator to the housing is obtained in a simple manner.

In another development, the outer walls of the motor housing and the bearing housing are divisible into top and bottom sections along a plane which includes the axis of the journal, and easily releasable securing means are provided for securing the top and bottom sections together. The outer walls of the motor housing and bearing housing may be integrally formed, for providing the substantially continuous outer surface of the drive system. Alternatively, the outer walls of the motor housing and bearing housing may be separately formed and partially closely overlapped for providing the substantially continuous outer surface of the drive system. These features give good accessibility to the parts of the motor for maintenance and repair, since they enable the removal of half of the housing, without it being necessary to remove the cylinder mounting. This is important inasmuch as such a motor can have a diameter of between one-half and one meter.

Another advantageous aspect of the invention relates to ventilation means for ventilating the motor housing. The ventilation means may comprise an opening in the bearing housing or an opening in the cover of the motor housing, or both. The removal of heat from the motor is thus assisted in a simple fashion.

BRIEF DESCRIPTION OF THE DRAWINGS

Other objects, features and advantages of the invention will be understood from the following detailed description of illustrative embodiments thereof, with reference to the drawings, in which.

DESCRIPTION OF ILLUSTRATIVE EMBODIMENTS

Figure 1:
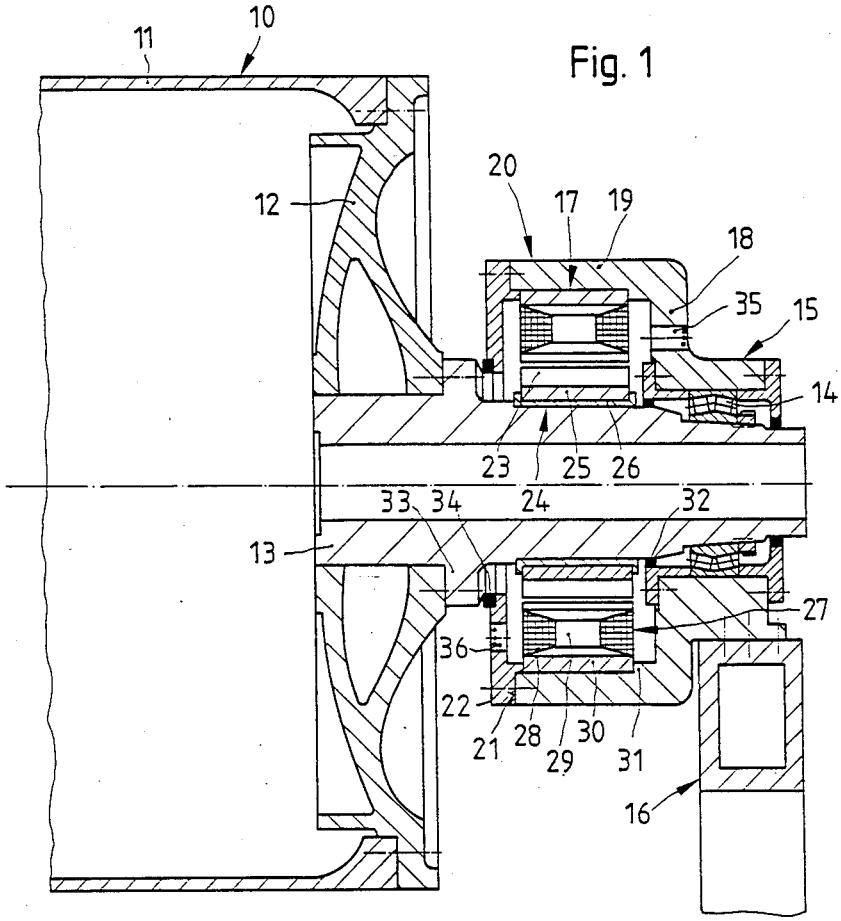
FIG. 1 is a longitudinal sectional view showing a first embodiment of the invention, wherein a drive motor is arranged on the journal of a drying cylinder between a bearing housing and the end wall of the cylinder.

The drying cylinder designated 10 in FIG. 1 has a shell 11 which is closed at its end by an end wall 12. This wall is bolted to a hollow journal 13 for feeding steam into the drying cylinder 10 and for removal of condensate from the cylinder. The journal 13 is supported at its end remote from the cylinder in a bearing housing 15 via an anti-friction bearing 14. The housing rests in a fixed position on a frame 16 which supports the drying cylinder 10, and also supports further cylinders and rollers of a dry end (not otherwise shown) of a paper, cardboard or coating machine.

Between the bearing housing 15 and the end wall 12, there is a motor 17 for driving the drying cylinder 10. In order to enclose the motor 17, there extends from the bearing housing 15, in this first embodiment, a radially outwardly extending side wall 18. Extending from the side wall 18, toward the drying cylinder 10, the bearing housing 15 is further extended by a wall which is concentric with the journal 13 and terminates at a certain distance from the end wall 12 of the drying cylinder 10. The side wall 18 and the concentric wall 19 form a hollow cylindrical motor housing 20 which is closed by a cover 22 on the end side 21 thereof toward the drying cylinder 10.

The electric drive motor 17 which is received by the motor housing 20 is a permanent-magnet motor, its rotor 24, which has permanent-magnet poles 23, being associated with the journal 13. The rotor 24 has a hollow cylindrical ring 25 which is fastened, with the interosition of a heat-insulating layer 26, on the journal 13. The permanent-magnet poles 23 are arranged, distributed circumferentially, on the rotor ring 25.

The stator 27 for the drive motor 17, which stator is circumferentially centered in the motor housing 20, has electromagnetic poles 29 having windings 28 thereon. The poles 29 are interconnected by a circumferential yoke 30 of the motor 17. For securing the stator 27 in the motor housing 20, the yoke 30 is clamped axially fast between a shoulder of the cover 22 and a shoulder 31 of the housing 20. The connection of the rotor 24 to the journal 13, and the connection of the stator 27 to the motor housing 20, can alternatively be effected by other form-locked and/or force-locked attachments such as bolt, wedge, or spline-and-feather attachments, or toothing.

The inside of the motor is sealed from the area within the bearing housing 15 and from the anti-friction bearing 14 by a radial packing 32 associated with the journal 13. It is sealed from the end wall 12 of the drying cylinder 10 by a lip-seal 34 which acts axially on a flange 33 of the journal. If surface cooling of the drive motor 17 is not sufficient, the motor housing 20 can be provided with openings 35, 36 in its side wall 18 and cover 22, respectively, for flushing the inside of the motor with cooling air.

Figure 2:
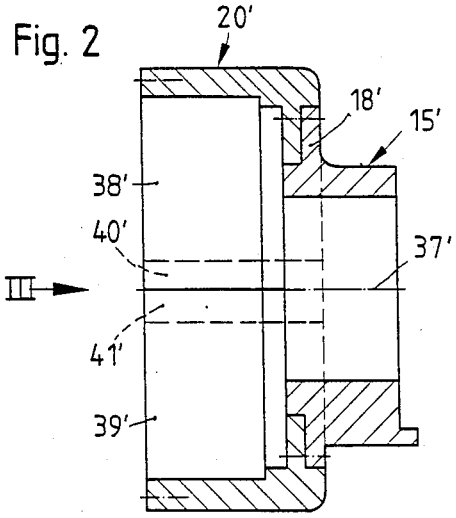
FIG. 2 is a longitudinal sectional view showing a second embodiment of the invention, taken through the line II—II of FIG. 3 showing a split motor housing which is attached by flanges to the housing of the bearing.
Figure 3:
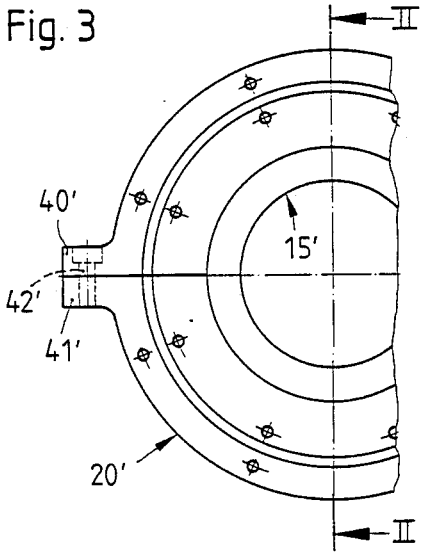
FIG. 3 is a view of the motor housing as seen in the direction of the arrow III in FIG. 2.

In an alternative embodiment, FIGS. 2 and 3 show a concentric motor housing 20' which is attached by a removable, generally radial flanged connection to a concentric bearing housing 15', the connection being in the region of the side wall 18'. Furthermore, the motor housing 20' is split along a horizontally extending plane 37' which includes the axis of the journal 13. Both parts 38' and 39' of the motor housing 20' have flanges 40' and 41' extending outwardly, both above and below the axial plane 37', and on opposite sides of the motor housing 20' (toward the left and right in FIG. 3). Along these flanges 40' and 41', the housing parts 38' and 39' are connected to each other by dowel screws 42'. By removal of one or both housing parts 38' and 39', the motor parts are accessible without removal of the cylinder mounting.

Although the invention has been described with reference to two illustrative embodiments thereof, it is to be understood that the same is by way of illustration and not limitation. Rather, modifications and variations of these embodiments may occur to one of ordinary skill in the art, still within the scope of the invention, as defined by the claims.

What is claimed is:

1. A drive system for rotating a workpiece such as a drying cylinder or the like, comprising:

a frame;

a bearing housing supported on the frame;

a bearing in the bearing housing;

a journal having a longitudinal axis, the journal having a first portion which is drivingly secured to the workpiece to be rotated, and a second portion remote from the workpiece which is supported in the bearing, and the bearing housing having an outer wall surrounding the bearing and the second portion of the journal;

a drive motor intermediate the first and second portions of the journal, and drivingly connected to the journal; wherein the drive motor is a permanent-magnet motor whose rotor includes inner poles secured to a rotor ring which is circumferentially secured to the journal, wherein a heat-insulating layer is interposed between the journal and the rotor ring and whose stator includes outer poles secured to the motor housing surrounding the inner poles wherein said inner and outer poles respectively form inner and outer rings concentrically surrounding the journal; and a motor housing surrounding the drive motor, the motor housing having an outer wall which is joined to the outer wall of the bearing housing, to form a substantially continuous outer surface for the drive system.

2. A drive system as in claim 1, wherein the outer walls of the motor housing and the bearing housing are both substantially concentric with the journal.

3. A drive system as in claim 2, wherein the outer walls of the motor housing and the bearing housing are both substantially cylindrical.

4. A drive system as in claim 3, wherein the outer poles are secured to a yoke which is secured to the outer wall of the motor housing.

5. A drive system as in claim 4, wherein the motor housing is closed by a cover secured to the outer wall of the motor housing at the end thereof toward the first end of the journal, and a seal is provided between the cover and the journal for sealing the motor housing.

6. A drive system as in claim 5, wherein respective cylindrical shoulders are formed in the cover and in the outer wall of the motor housing, the shoulders being axially directed toward each other for holding the yoke of the stator therebetween.

7. A drive system as in claim 3, wherein the outer walls of the motor housing and the bearing housing are divisible into top and bottom sections along a plane which includes the axis of the journal, and easily releasable securing means are provided for securing the top and bottom sections together.

8. A drive system as in claim 7, wherein the outer walls of the motor housing and bearing housing are integrally formed, for providing the substantially continuous outer surface of the drive system.

9. A drive system as in claim 7, wherein the outer walls of the motor housing and bearing housing are separately formed and are partially closely overlapped for providing the substantially continuous outer surface of the drive system.

10. A drive system as in claim 1, wherein the outer walls of the motor housing and bearing housing are joined by a generally radial portion of the outer surface of the drive system.

11. A drive system as in claim 1, further comprising ventilation means for ventilating the motor housing.

12. A drive system as in claim 11, wherein the ventilation means comprises an opening formed in the motor housing.

13. A drive system as in claim 11, wherein the ventilation means comprises an opening formed in the cover of the motor housing.

14. A drive system for rotating a workpiece such as a drying cylinder or the like, comprising:

frame means;

bearing means supported on the frame means;

a journal having a longitudinal axis, the journal having a first portion which is drivingly secured to the workpiece to be rotated, and a second portion remote from the workpiece which is supported in the bearing means;

a drive motor supported on the frame means and drivingly connected to the journal; and a motor housing supported on the frame means and surrounding the drive motor; the drive motor being a permanentmagnet motor whose rotor includes inner permanent-magnet poles secured to a rotor ring which is circumferentially secured to the journal, wherein a heat-insulating layer is interposed between the journal and the rotor ring, and whose stator includes outer electromagnet poles secured to the motor housing surrounding the inner poles, wherein said inner and outer poles respectively form inner and outer rings concentrically surrounding the journal.

15. A drive system as in claim 14, wherein the drive motor is intermediate the first and second portions of the journal.

16. A drive system as in claim 14, wherein the outer poles are secured to a yoke which is secured to the outer wall of the motor housing.

17. A drive as in claim 1, wherein the inner poles are permanent-magnet poles and the outer poles are electromagnet poles.

* * * * *